US005670464A

United States Patent [19]

Kita et al.

[11] Patent Number: 5,670,464

[45] Date of Patent: Sep. 23, 1997

[54] ADDITIVE FOR LUBRICATING OILS FOR DIESEL ENGINES AND LUBRICATING OIL COMPOSITIONS CONTAINING THE SAME

[75] Inventors: Kazuo Kita; Takashi Ohtani; Jiro Hashimoto, all of Wakayama, Japan

[73] Assignee: Kao Corporation, Tokyo, Japan

[21] Appl. No.: 535,953

[22] Filed: Sep. 28, 1995

[51] Int. Cl.[6] ..... C10M 133/08

[52] U.S. Cl. ..... 508/562

[58] Field of Search ..... 252/51.5 R; 508/562

[56] References Cited

U.S. PATENT DOCUMENTS

| | | | |
|---|---|---|---|
| 2,856,363 | 10/1958 | Brennan | 252/33.6 |
| 3,398,197 | 8/1968 | Miller, Jr. et al. | 252/51.5 R |
| 3,779,920 | 12/1973 | Devries . | |
| 3,794,586 | 2/1974 | Kimura et al. | 252/51.5 R |
| 4,089,791 | 5/1978 | Haugen et al. . | |
| 4,224,170 | 9/1980 | Haugen . | |
| 4,231,883 | 11/1980 | Malec | 252/51.5 R |
| 4,259,086 | 3/1981 | Machleder et al. . | |
| 4,409,000 | 10/1983 | LeSuer | 252/51.5 R |
| 4,681,694 | 7/1987 | Zoleski et al. | 252/51.5 R |
| 4,704,217 | 11/1987 | Sweeney et al. | 252/51.5 R |
| 4,762,628 | 8/1988 | Phillips et al. | 252/51.5 R |
| 4,830,770 | 5/1989 | Wirth et al. | 252/51.5 R |
| 4,925,582 | 5/1990 | Bennett | 252/51.5 R |
| 4,943,381 | 7/1990 | Phillips et al. | 252/51.5 R |
| 5,068,046 | 11/1991 | Blain et al. . | |
| 5,078,893 | 1/1992 | Ryer et al. | 252/51.5 R |
| 5,320,768 | 6/1994 | Gutierrez et al. | 252/51.5 R |

FOREIGN PATENT DOCUMENTS

| | | |
|---|---|---|
| 0239536 | 9/1987 | European Pat. Off. . |
| 2172284 | 9/1986 | United Kingdom . |

*Primary Examiner*—Ellen M. McAvoy

*Attorney, Agent, or Firm*—Birch, Stewart, Kolasch & Birch, LLP

[57] ABSTRACT

An additive for lubricating oils for diesel engines, comprising one or more kinds of amino alcohols which have one or more amino groups and one or more hydroxyl groups in a molecule and possess a function of dispersing water-containing calcium sulfate in oil, the hydroxyl groups being bound to the carbon atoms at the β-positions to the amino groups; and a lubricating oil composition for diesel engines, which comprises the additives in an amount of from 0.1 to 10% by weight.

8 Claims, 2 Drawing Sheets

ADDITIVE FOR LUBRICATING OILS FOR DIESEL ENGINES AND LUBRICATING OIL COMPOSITIONS CONTAINING THE SAME

BACKGROUND OF THE INVENTION

1. Field of the Invention

The present invention relates to an additive for lubricating oils for diesel engines for land use, marine use, and the like, and to a lubricating oil composition containing the same. More specifically, the invention relates to an additive for lubricating oils for diesel engines which improves the detergency of a lubricating oil and lengthens the life of the lubricating oil, and to a lubricating oil composition containing such an additive.

2. Discussion of the Related Art

Recently, the needs for high power, low fuel consumption, and free-maintenance have been increased for diesel engines for land use and piston/cylinder type engines for marine use and generators. This in turn creates a demand for engine oils with high performance and long duration of life. Among various functions of an engine oil, the function of deterging the surface around the piston and friction portions of a piston is important to maintain various other functions of the oil and lengthen the life duration of the oil.

In the case of diesel engines, however, the above needs have not been met yet, because the deterging function of an oil is impaired by the influence of fuel gas.

In engines for marine use and electric generators, poorly graded fuels which contain distillation residues of petroleum at high contents are used to reduce cost. Since the poorly graded fuels contain a large amount of sulfur compounds, the combustion gas contains not only a high amount of sulfur oxides but also nitrogen oxides. The sulfur compounds and nitrogen oxides condense in the engine to form dues of sulfuric acid and nitric acid, and promote the formation and disposition of sludge. The contaminants such as sulfuric acid and nitric acid promote the degradation of the engine oil and agglomerate of unburned combustibles (soot), which, together with accelerated corrosion, cause the deposition of sludge around the piston groove and bearing. As a result, damages on the parts such as the piston ring and piston bearing occur to cause serious problems.

In the case with diesel engines for land use, the EGR (Exhaust Gas Recirculation) system is begun to be adopted in response to the recent legal restriction on an exhaust gas. This makes the inside of an engine more exposed to the influence of the combustion gas. The atmosphere of the combustion gas promotes oxidative degradation of the oil, and accelerates the deposition of sludge on the piston groove and bearing.

It has been confirmed that the above acid contaminants in a lubricating oil accelerate the degradation of the oil and thereby significantly impair the various functions of the oil. This finally requires frequent changes and replenishment of lubricating oils. The contamination of an engine oil with acid substances particularly impairs the deterging function of the oil for cleaning the internal part of the engine. Therefore, decomposition products of the oil, combustion products, abrasion powder, and the like together form sludge deposition around a piston and cylinder liner, and thereby further accelerate the abrasion of sliding parts of the piston. This eventually affects the operation of the engines because normal compression ratio cannot be obtained.

As a solution to the problem of formation of acidic substances, an additive called metal-base detergent has been used to reduce oxidative degradation of lubricating oil by neutralizing the acid substances formed in an engine (Sekiyu Gakkai Shi, Vol. 35, No. 1, 1992, Development of overbased phenate sulfide and sulfide type salicylate).

As mentioned later, metal-base detergents are carboxylic acid salts, sulfonic acid salts, phenolares or carbonates of alkali earth metals such as calcium and magnesium, which are dissolved or dispersed in a lubricating oil and neutralize acid contaminants in the lubricating oil.

The metal-base detergents, however, contain metals such as calcium, and therefore their ash contents are high. This poses a problem of accumulating residues in the high-temperature region around the combustion chamber and the wall on the piston side. Also, sulfates (e.g. calcium sulfate) and nitrates (e.g. calcium nitrate), which are formed from metal-based detergents and acid substances, absorb water and adhere onto the piston ring, piston groove, and other parts around the piston. These nitrates and sulfates, when they absorb water, tend to gather soot at high temperatures (150° to 300° C.) and undesirably facilitate the formation of soot sludges.

As ashless dispersants for lubricating oil compositions for diesel engines, products obtained by the reaction between a long alkyl substituted succinic acid and a polyalkylene polyamine, or the derivatives thereof, as disclosed in JP-A-52-102892 and JP-A-61-257968, are sometimes used.

The ashless dispersants as above are highly effective in dispersing inorganic substances which do not contain water in oil, but fails to exert satisfactory effect in dispersing inorganic substances which contain water produced during combustion.

As mentioned above, an additive for lubricating oil for diesel engines and a lubricating oil composition for diesel engines, which can be suitably used in the hostile environment in the engine created by the use of poorly graded fuel and restrictions on an exhaust gas, have not been obtained yet.

SUMMARY OF THE INVENTION

It is accordingly a principal object of the present invention to provide an additive for lubricating oils for diesel engines and a lubricating oil composition containing the same, the additive being capable of improving the deterging function of a lubricating oil for diesel engines for land use, marine use and generators, and thereby lengthening the duration of life of the lubricating oil.

In order to achieve the above object, the present inventors conducted intense research on the degradation of a lubricating oil for diesel engines and the formation of sludge around the piston and the cylinder liner, and found that the soot sludge around the piston is formed owing to water absorption of inorganic salts such as calcium sulfate. Also found was that by adding amino alcohols obtained by an epoxy ring opening reaction of a primary or secondary amine with an epoxy compound to a lubricating oil, calcium sulfate which has absorbed water in the oil becomes highly oil-dispersible; the ability of the lubricating oil to disperse the soot and sludge in the oil is enhanced; the deterging function of the oil is significantly improved; and the amount of metal-base detergents added to the lubricating oil can be reduced; and with the above improvements, the duration of life of the lubricating oil can be lengthened. Based upon these findings, the present invention has been completed.

The gist of the present invention relates to an additive for lubricating oils for diesel engines, comprising one or more kinds of amino alcohols which have in the molecule amino groups and hydroxyl groups at the β-position to the amino groups and functions to disperse water-containing calcium sulfate in oil, and a lubricating oil composition comprising the same.

The additive for lubricating oils for diesel engines of the present invention markedly improves the detergency of the lubricating oils, and thereby reduce the amount of metal-base detergents and lengthen the duration of life of the oils.

BRIEF DESCRIPTION OF THE DRAWINGS

The present invention will become more fully understood from the detailed description given hereinbelow and the accompanying drawings which are given by way of illustration only, and thus, are not limitative of the present invention and wherein.

Figure 1:
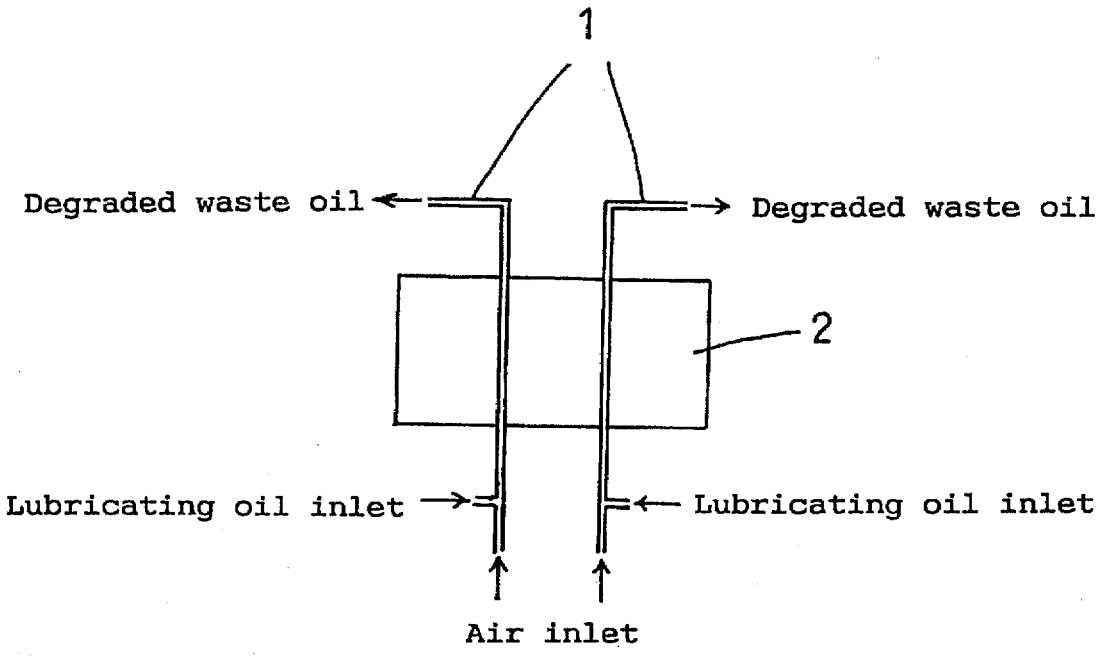
FIG. 1 is a schematic view of the hot tube tester used for the evaluation of the detergency of the lubricating oil compositions in Example 1.

The reference numerals in FIG. 1 denote the following elements:

Element 1 is a glass tube, and element 2 is a heating means.

DETAILED DESCRIPTION OF THE INVENTION

The present invention is described in detail below.

The additive for lubricating oils for diesel engines of the present invention comprises one more kinds of amino alcohols which have in the molecule amino groups and hydroxyl groups at the β-position to the amino group and functions to disperse water-containing calcium sulfate in oil. The amino alcohols are prepared by the reaction involving epoxy ring opening between an amine compound having one or more primary and/or secondary amino groups and a compound having one or more epoxy groups.

1) Amine Compounds

Amine compounds in the present invention are compounds having one or more primary and/or secondary amino groups in the molecule, and those having a molecular weight of from 29 to 2500 are suitably used. Specific examples of the amine compounds are primary amines, secondary amines, and polyalkylene polyamines as set forth below.

(1) The primary amines used in the present invention have a structure represented by formula (I).

$$R_1—NH_2 \quad (I)$$

In the formula, $R_1$, with or without having a hydroxyl group, represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms, the number of carbon atoms preferably being in the range between 6 and 22 for alkyl, alkenyl and aryl groups and between 7 and 22 for aralkyl group. The definition "with or without having a hydroxyl group" is to be applied to alkyl, alkenyl, aryl, and aralkyl groups, and all the similar definitions in the present specification and claims should be interpreted accordingly. The maximal number of carbon atoms of aryl or aralkyl group is 22, and this interpretation should be applied to all the similar definitions in the present specification and claims.

Suitable compounds represented by formula (I) include monomethylamine, monoethylamine, monopropylamine, monobutylamine, monopentylamine, monohexylamine, monoheptylamine, monooctylamine, monolaurylamine, monomyristylamine, monopalmitylamine, monostearylamine, monooleylamine, monobehenylamine, monophenylamine, mononaphtylamine, monobenzylamine, monoethanolamine, monopropanolamine, vinylamine, 1-propenylamine, and 1,3-butadienylamine. Preferred amines depend on the kind of the epoxy compound used in the reaction, and those having 2 to 18 carbon atoms are preferably used.

(2) The secondary amines used in the present invention have a structure represented by formula (II).

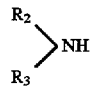

(II)

In the formula, $R_2$ and $R_3$ may be identical or different, and each, with or without having a hydroxyl group, represents a linear alkyl group having 1 to 22 carbon atoms, an linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms, the number of carbon atoms preferably being in the range between 6 and 22 for alkyl, alkenyl and aryl groups and between 7 and 22 for aralkyl group.

Suitable compounds represented by formula (II) include dimethylamine, methylethylamine, diethylamine, dipropylamine, ethylisopropylamine, dibutylamine, dihexylamine, dioctylamine, ditaurylamine, dimyristylamine, dipalmitylamine, distearylamine, dioleylamine, dibehenylamine, diphenylamine, dibenzylamine, di-2-ethylhexylamine, diethanolamine, and dipropanolamine. Preferred amines depend on the kind of the epoxy compound used in the reaction, and those having 2 to 18 carbon atoms are preferably used.

(3) The polyalkylene polyamines having primary and/or secondary amines used in the present invention have a structure represented by formula (III).

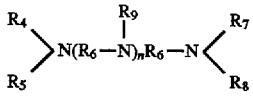

(III)

In the formula, $R_4$, $R_5$, $R_7$, $R_8$ and $R_9$ may be identical or different, and each represents a hydrogen atom, a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms, the number of carbon atoms preferably being in the range between 6 and 22 for alkyl, alkenyl and aryl groups and between 7 and 22 for aralkyl group; $R_6$ is an alkylene group having 2 to 4 carbon atoms; and n is a number of 0 to 20.

Suitable compounds represented by formula (III) include ethylenediamine, diethylenetriamine, triethylenetetramine, tetraethylenepentamine, pentaethylenehexamine, polyethyleneimine, propylenediamine, dipropylenetriamine, tripropylenetetramine, pentapropylenehexamine, buthylenediamine, dibutylenetriamine, tributylenetetramine, tetrabutylenepentamine, pentabutylenehexamine, monostearylpropylenediamine, monooleylpropylenediamine, monopalmitylpropylenediamine, monolaurylpropylenediamine, monostearylethylenediamine, monooleylethylenediamine, and monolaurylethylenediamine. Among the polyalkylene polyamines above, a preference is given to ethylenediamine, diethylenetriamine, triethylenetetramine, tetraethylenepentamine, pentaethylenehexamine, monostearylpropylenediamine, and oleylpropylenediamine. High molecular polyamines are economically disadvantageous because the synthetic products have very high viscosities and require special solvents. Therefore, n is preferably in the range between 0 and 20, more preferably in the range between 0 and 6.

2) Epoxy Compounds

The epoxy compounds used in the synthesis of amino alcohols of the present invention include (A) compounds having one epoxy group in the molecule, and (B) compounds having 2 to 4 epoxy groups in the molecule. 1,2-epoxy group is preferred because it provides the resulting amino alcohols with good oil-solubility and good affinity to sludge.

(A) Epoxy compounds having one epoxy group in the molecule (1) The molecule of the epoxy compounds used in the present invention preferably has a hydroxyl group because the adsorption of the resulting amino alcohols onto sludge becomes higher. Examples of the epoxy compounds having a hydroxyl group in the molecule are 1,2-epoxypropanol, glycerol monoglycidyl ether, trimethylolpropane monoglycidyl ether, pentaerythritol monoglycidyl ether, ethylene glycol monoglycidyl ether, bis phenol A monoglycidyl ether, and propylene glycol monoglycidyl ether. The epoxy compounds as described here do not give oil-soluble products, unless they are made to react with amine compounds of relatively long chain.

(2) Paraffin epoxy compounds used in the present invention are those represented by formula (XVI):

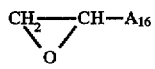

(XVI)

In the formula, $A_{16}$ is a linear alkyl group having 1 to 20 carbon atoms, a linear alkenyl group having 2 to 20 carbon atoms, a branched alkyl or alkenyl group having 3 to 20 carbon atoms, an aryl group having 6 to 20 carbon atoms, or an aralkyl group having 7 to 20 carbon atoms.

Examples of the compounds represented by formula (XVI) include 1,2-epoxypropane, 1,2-epoxybutane, 1,2-epoxyoctane, 1,2-epoxydecane, 1,2-epoxydodecane, 1,2-epoxytetradecane, 1,2-epoxyhexadecane, 1,2-epoxyoctadecane, and 1,2-epoxyeicosane.

(3) Ether epoxy compounds used in the present invention are those represented by formula (XVII):

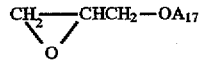

(XVII)

In the formula, $A_{17}$ represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms.

Examples of the compounds represented by formula (XVII) include ethyl glycidyl ether, propyl glycidyl ether, octyl glycidyl ether, 2-ethylhexyl glycidyl ether, lauryl glycidyl ether, myristyl glycidyl ether, palmityl glycidyl ether, stearyl glycidyl ether, oleyl glycidyl ether, behenyl glycidyl ether, phenol glycidyl ether, octylphenol glycidyl ether, and nonylphenol glycidyl ether.

(4) Ester epoxy compounds used in the present invention are those represented by formula (XVIII):

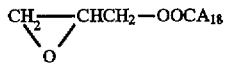

(XVIII)

In the formula, $A_{18}$ represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. Each of these groups may have a hydroxyl group.

Examples of the compounds represented by formula (XVIII) include acetic acid glycidyl ester, methacrylic acid glycidyl ester, 2-ethylhexylic acid glycidyl ester, caprylic acid glycidyl ester, lauric acid glycidyl ester, myristic acid glycidyl ester, palmitic acid glycidyl ester, stearic acid glycidyl ester, oleic acid glycidyl ester, and behenic acid glycidyl ester.

(B) Epoxy compounds having 2 to 4 epoxy groups in the molecule

In the present invention, among epoxy compounds having 2 to 4 epoxy groups in the molecule, those having 4 to 30 carbon atoms are preferably used because the amino alcohols obtained are highly effective in dispersing sludge in oil.

Diglycidyl ether is an example of the compounds having 2 epoxy group in the molecule. Since a polymerization reaction takes place between diglycidyl ether and polyamines, diglycidyl ether is made to react with a secondary amine to give amino alcohols of the present invention. When diglycidyl ether is made to react with a primary amine, the molar amount of the primary amine should be adjusted equivalent to that of epoxy groups of the diglycidyl ether in order to give the reaction product with good function of dispersing water-containing calcium sulfate in oil.

Examples of the compounds having 2 to 4 epoxy groups in the molecule which, like diglycidyl ether, can be used in the synthesis of the amino alcohols of the present invention are glycerol triglycidyl ether, glycerol diglycidyl ether, trimethylolpropane triglycidyl ether, trimethylolpropane diglycidyl ether, pentaerythritol tetraglycidyl ether, pentaerythritol triglycidyl ether, pentaerythritol diglycidyl ether, ethylene glycol diglycidyl ether, bisphenol A diglycidyl ether, propylene plycol diglycidyl ether, tartaric acid diglycidyl ester, succinic acid diglycidyl ester, malic acid diglycidyl ester, maleic acid diglycidyl ester, citric acid triglycidyl ester, and trimellitic acid triglycidyl ester. Since the molecular weight of the compounds listed above becomes large when they are made to react with polyamines, good additives of the present invention can be obtained by reacting these compounds with secondary amines.

3) Amino Alcohols of the Present Invention

The amino alcohols of the present invention are those obtained by the reaction between an amine compound as mentioned above and an epoxy compound as mentioned above, the reaction involving opening of an epoxy ring. Examples of the amino alcohols are as below:

A: Amino alcohols obtained using a compound having one epoxy group in the molecule (1) Compound "a" represented by formula (XIX) and Compound "b" represented by formula (XX) are amino alcohols obtained by the reaction of a primary monoamine with 1,2-epoxypropanol, or with a compound prepared by treating a hydroxyl group of a polyhydric alcohol to form a glycidyl ether bond (this treatment hereinafter is referred to as glycidyl etherification), such as glycerol monoglycidyl ether and pentaerythritol monoglycidyl ether. In the formulae, $A_{19}$ and $A_{20}$ may be identical or different, each representing a hydrogen atom or an polyhydric alcohol residue. $A_{21}$ represents a hydrogen atom or a polyhydric alcohol residue. $R_{37}$ and $R_{38}$ independently are a linear or branched alkyl or alkenyl, or an aryl, each having 6 to 22 carbon atoms, or an aralkyl group having 7 to 22 carbon atoms. When the number of carbon atoms is less than 6, the oil-solubility becomes undesirably low to cause a problem in use.

Compound "a" can readily be obtained by the reaction of one mole of a primary amine with 2 moles of 1,2-epoxypropanol, or with a compound obtained by glycidyl etherification of a hydroxy group of a polyhydric alcohol, such as glycerol monoglycidyl ether, and pentaerythritol monoglycidyl ether. When $R_{37}$ is an alkyl group, the number of carbon atoms is preferably 8 to 18, more preferably 10 to 18.

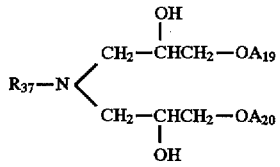

(XIX)

Compound a

Compound "b" can be obtained by the reaction of one mole of a primary amine with one mole of 1,2-epoxypropanol, or with a compound obtained by glycidyl etherification of a hydroxy group of a polyhydric alcohol, such as glycerol monoglycidyl ether, and pentaerythritol monoglycidyl ether. In this reaction, Compound "b" is obtained as a mixture with Compound "a." When $R_{38}$ is an alkyl group, the number of carbon atoms is preferably 8 to 16, more preferably 10 to 16.

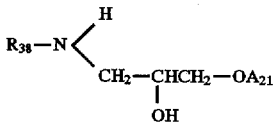

(XX)

Compound b (2) Compound "c" represented by formula (XXI) is an amino alcohol obtained by the reaction of a secondary monoamine with 1,2-epoxypropanol, or with a compound prepared by glycidyl etherification of a hydroxyl group of a polyhydric alcohol, such as glycerol monoglycidyl ether and pentaerythritol tetraglycidyl ether. In the formula, $A_{22}$ is a hydrogen atom or a polyhydric alcohol residue. $R_{39}$ and $R_{40}$ may be identical or different, and each, with or without having a hydroxyl group, represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms for $R_{39}+R_{40}$ is preferably not less than 6 (specifically in the range of 6 to 44). When the total number of carbon atoms is less than 6, the oil-solubility becomes undesirably low to cause a problem in use. Thus, even though the carbon number of $R_{39}$ is 1, the compound can be suitably used when the carbon number of $R_{40}$ is not less than 6.

The number of carbon atoms for Compound "c," $R_{39}+R_{40}$, is preferably 10 to 30, more preferably 10 to 24.

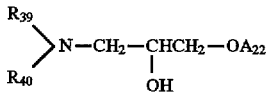

(XXI)

Compound c (3) Compound "d" represented by formula (XXII) is an amino alcohol obtained by the reaction of polyalkylene polyamines including primary and secondary amines with 1,2-epoxypropanol, or with a compound prepared by glycidyl etherification of a hydroxyl group of a polyhydric alcohol, such as glycerol monoglycidyl ether and pentaerythritol tetraglycidyl ether. Polyalkylene polyamines having a carbon number for $R_{41}+R_{43}+R_{44}+R_{45}$ of not less than 6 (specifically 6 to 88) are used. When the total number of the carbon atoms is below 6, the oil-solubility becomes undesirably low to cause a problem in use.

In the formula, $A_{23}$ represents a hydrogen atom or a polyhydric alcohol residue. $R_{41}$, $R_{43}$, $R_{44}$, and $R_{45}$ may be identical or different, and each represents a hydrogen atom, $HOCH_2CH(OH)CH_2$—, a linear or branched alkyl or alkeny group having 6 to 22 carbon atoms, an aryl group having 6 to 22 carbon atoms, or aralkyl group having 7 to 22 carbon atoms. $R_{42}$ represents an alkylene group having 2 to 4 carbon atoms, and the repeating number "n" is in the range of from 0 to 20. When "n" is more than 20, the viscosity becomes so high that dilution with a solvent upon synthesis should be increased, thereby causing economical disadvantages.

The number of carbon atoms of the alkyl groups of Compound "d" is preferably 10 to 30 for $R_{41}+R_{43}+R_{44}+R_{45}$, and 2 for $R_{42}$. n is preferably 0 to 4.

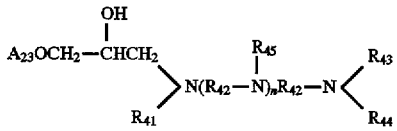

(XXII)

Compound d (4) Compound "e" represented by formula (IV) and Compound "f" represented by formula (V) are products of the reaction of a primary monoamine with a paraffin epoxy compound (formula (XVI)). In the formulae, $A_1$ and $A_2$ may be identical or different, and each represents a linear alkyl group having 1 to 20 carbon atoms, a linear alkenyl group having 2 to 20 carbon atoms, a branched alkyl or alkenyl group having 3 to 20 carbon atoms, an aryl group having 6 to 20 carbon atoms, or an aralkyl group having 7 to 20 carbon atoms. $R_{10}$, with or without having a hydroxyl group, represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. $A_3$ represents a linear alkyl group having 1 to 20 carbon atoms, a linear alkenyl group having 2 to 20 carbon atoms, a branched alkyl or alkenyl group having 3 to 20 carbon atoms, an aryl group having 6 to 20 carbon atoms, or an aralkyl group having 7 to 20 carbon atoms. $R_{11}$, with or without having a hydroxyl group, represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms.

When the total numbers of carbon atoms for $R_{10}$, $A_1$ and $A_2$ of Compound "e" and for $R_{11}$ and $A_3$ of Compound "f"

are respectively not less than 6 (specifically 6 to 62), the compounds are soluble in oil and suitably used in the present invention. The total number of carbon atoms of Compound "e" is preferably 10 to 30, more preferably 10 to 24. The total number of carbon atoms of Compound "f" is preferably 10 to 24, more preferably 10 to 20.

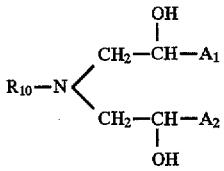

(IV)

Compound e

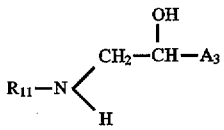

(V)

Compound f (5) Compound "g" represented by formula (VI) is a product of the reaction of a secondary monoamine with a paraffin epoxy compound (formula (XVI)). In the formula, $R_{12}$ and $R_{13}$ may be identical or different, and each, with or without having a hydroxyl group, represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. $A_4$ represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms.

The total numbers of carbon atoms for $A_4+R_{12}+R_{13}$ of Compound "g" is 6 to 64, preferably 10 to 30, more preferably 10 to 24.

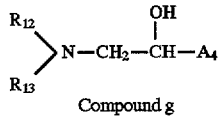

(VI)

Compound g

Among the compounds represented by formula (VI) (Compound "g"), the compounds in which $R_{12}$ and $R_{13}$ are—$CH_2CH_2OH$, and $A_4$ is a linear or branched alkyl group having 10 to 18 carbon atoms, preferably 10 to 14 carbon atoms are preferred because of its function of dispersing water-containing calcium sulfate in oil. Suitable examples are the compounds represented by formula (XXXVII).

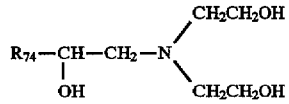

(XXXVII)

wherein $R_{74}$ represents a linear or branched alkyl group having 10 to 14 carbon atoms.

(6) Compound "h" represented by formula (VII) is a product of the reaction of polyalkylene polyamines including primary and secondary amines with a paraffin epoxy compound (formula (XVI)).

In the formula, $A_5$ is a linear alkyl group having 1 to 20 carbon atoms, a linear alkenyl group having 2 to 20 carbon atoms, a branched alkyl or alkenyl group having 3 to 20 carbon atoms, an aryl group having 6 to 20 carbon atoms, or an aralkyl group having 7 to 20 carbon atoms; $R_{14}$, $R_{16}$, $R_{17}$, and $R_{18}$ may be identical or different, and each represents $A_5$—$CH(OH)CH_2$—, a hydrogen atom, a linear alkyl group having 1 to 22 carbon atoms, an alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. $R_{15}$ is an alkylene group having 2 to 4 carbon atoms, preferably 2 carbon atoms. n represents a number of 0 to 20, preferably 0 to 4. When "n" is more than 20, the viscosity becomes so high that the dilution with a solvent upon synthesis should be increased, thereby causing economical disadvantages. The total number of carbon atoms of $R_{14}+R_{16}+R_{17}+R_{18}+A_5$ is preferably not less than 6 (specifically in the range of 6 to (86+22n)), more preferably 10 to 30. $R_{14}$, $R_{16}$, $R_{17}$ and $R_{18}$ may react with an epoxy compound.

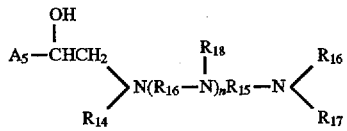

(VII)

Compound h (7) Compound "i" represented by formula (VIII) and Compound "j" represented by formula (IX) are products of the reaction of a secondary monoamine with ether epoxy compounds (formula (XVII)).

In formula (VIII), $A_6$ and $A_7$ may be identical or different, and each represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. $R_{19}$, with or without having a hydroxyl group, represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms of $R_{19}+A_6+A_7$ is not less than 6 (specifically in the range of from 6 to 66), preferably 10 to 30, more preferably 10 to 24.

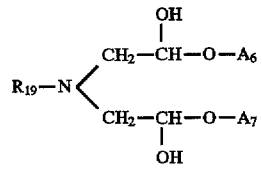

(VIII)

Compound i

In formula (IX), $A_8$ represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. $R_{20}$, with or without having a hydroxyl group, represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms of $R_{20}+A_8$ is not less than 6 (specifically in the range of from 6 to 44), preferably 10 to 30, more preferably 10 to 24.

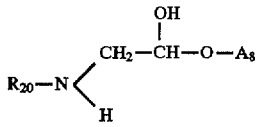

(IX)

Compound j (8) Compound "k" represented by formula (X) is a product of the reaction of a secondary monoamine with an ether epoxy compound (formula (XVII)). In the formula, $A_9$ represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. $R_{21}$ and $R_{22}$ may be identical or different, and each, with or without having a hydroxyl group, represents an alkyl group having 1 to 22 carbon atoms, an alkenyl group having 2 to 22 carbon atoms, an aryl group having 6 to 22 carbon atoms, or an aralkyl group having 7 to 22 carbon atoms. The total number of carbon atoms of $A_9+R_{21}+R_{22}$ is not less than 6 (specifically in the range of from 6 to 66), preferably 10 to 30, more preferably 10 to 24.

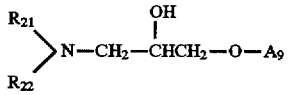

(X)

Compound k

Among the compounds represented by formula (X) (compound "k"), the compounds in which $R_{21}$ and $R_{22}$ are—$CH_2CH_2OH$, and $A_9$ is a linear or branched alkyl group having 10 to 18 carbon atoms, preferably 10 to 14 carbon atoms, are preferred because of its high ability of dispersing water-containing calcium sulfate in oil. Suitable examples are the compounds represented by formula (XXXVIII).

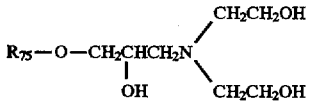

(XXXVIII)

wherein $R_{75}$ represents a linear or branched alkyl group having 10 to 14 carbon atoms.

(9) Compound "l" represented by formula (XI) is a product of the reaction of polyalkylene polyamines containing primary and/or secondary amines and an ether epoxy compounds (formula (XVII)).

In formula (XI), $A_{10}$ represents a linear alkyl group having 1 to 20 carbon atoms, a linear alkenyl group having 2 to 20 carbon atoms, a branched alkyl or alkenyl group having 3 to 20 carbon atoms, an aryl group having 6 to 20 carbon atoms, or an aralkyl group having 7 to 20 carbon atoms. $R_{23}$, $R_{25}$, $R_{26}$ and $R_{27}$ may be identical or different, and each represents $A_{10}$—O—$CH(OH)CH_2$—, a hydrogen atom, a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms of $A_{10}+R_{23}+R_{25}+R_{26}+R_{27}$ is not less than 6 (specifically in the range of from 6 to (86+22n)), preferably 10 to 30. $R_{24}$ represents an alkylene group having 2 to 4 carbon atoms, preferably 2 carbon atoms. n is a number of 0 to 20, preferably 0 to 4.

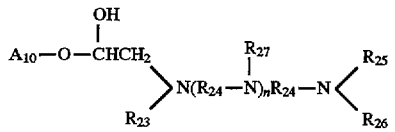

(XI)

Compound l

(10) Compound "m" represented by formula (XII) and Compound "n" represented by formula (XIII) are products of the reaction of a primary amine with an ester epoxy compounds (formula (XVIII)).

In formula (XII), $A_{11}$ and $A_{12}$ may be identical or different, and each, with or without having a hydroxyl group, represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. $R_{28}$, with or without having a hydroxyl group, represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms of $A_{11}+A_{12}+R_{28}$ is not less than 6 (specifically in the range of from 6 to 66), preferably 10 to 30, more preferably 10 to 24.

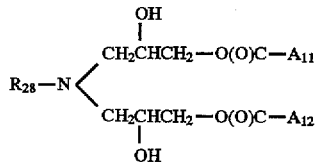

(XII)

Compound m

In formula (XIII), $A_{13}$, with or without having a hydroxyl group, represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. $R_{29}$, with or without having a hydroxyl group, represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms of $A_{13}+R_{29}$ is not less than 6 (specifically in the range of from 6 to 44), preferably 10 to 25, more preferably 10 to 22.

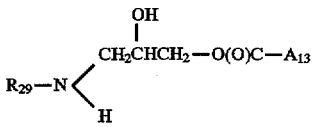

(XIII)

Compound n

(11) Compound "o" represented by formula (XIV) is a product of the reaction of a secondary amine and an ester epoxy compound (formula (XVIII)). In the formula, $A_{14}$, with or without having a hydroxyl group, represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. $R_{30}$ and $R_{31}$ may be identical or different, and each, with or without having a hydroxyl group, represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms of $A_{14}+R_{30}+R_{31}$ is not less than 6 (specifically in the range of from 6 to 66), preferably 10 to 30, more preferably 10 to 24.

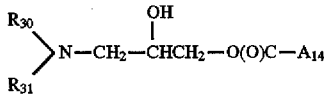

(XIV)

Compound o

Among the compounds represented by formula (XIV) (Compound "o"), the compounds in which $R_{30}$ and $R_{31}$ are—$CH_2CH_2OH$, and $A_{14}$ is a linear or branched alkyl group having 10 to 18 carbon atoms, preferably 10 to 14 carbon atoms, are preferred because of having a high ability of dispersing water-containing calcium sulfate in oil. Suitable examples are the compounds represented by formula (XXXIV).

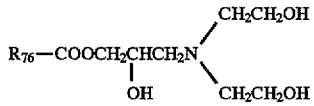

(XXXIV)

wherein $R_{76}$ represents a linear or branched alkyl group having 10 to 14 carbon atoms.

(12) Compound "p" represented by formula (XV) is a product of the reaction of a polyalkylene polyamine containing primary and/or secondary amines with an ester epoxy compound (formula (XVIII)).

In the formula, $A_{15}$ represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. $R_{32}$, $R_{34}$, $R_{35}$ and $R_{36}$ may be identical or different, and each represents $A_{15}$—C(O)$OCH_2$—CH(OH)$CH_2$—, a hydrogen atom, a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms of $A_{15}+R_{32}+R_{34}+R_{35}+R_{36}$ is not less than 6 (specifically in the range of from 6 to (86+22n)), preferably 10 to 30. $R_{33}$ represents an alkylene group having 2 to 4 carbon atoms. n is a number of 0 to 20, preferably 0 to 4.

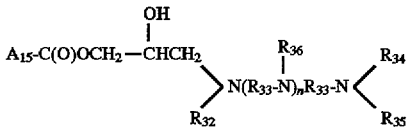

(XV)

Compound p

B: Amino alcohols obtained using a compound having 2 to 4 epoxy groups in the molecule The product of the reaction of a compound having 2 to 4 epoxy groups in the molecule with a secondary amine is particularly useful as the additive of the present invention. Such epoxy compounds include glycidyl ethers of polyhydric alcohols, and glycidyl esters of dibasic acids and tribasic acids. The reaction of the above epoxy compound with a secondary amine can give a compound which effectively disperses water-containing calcium sulfate in oil. In order to ensure the solubility of the resulting compound, the number of carbon atoms of the secondary amine is preferably not less than 6.

In the above reaction of an epoxy compound with a secondary amine, all the epoxy groups may react with the amine compound, or a part of the epoxy groups may remain unchanged, or the ring of the unchanged epoxy groups may be opened to give a hydroxyl group. All these reaction products can be used as additives of the present invention.

Among the compounds obtained by the reaction of an epoxy compound having 2 to 4 epoxy groups in the molecule with a secondary amine, those especially useful for the present invention are exemplified below.

(1) Compound "q" represented by formula (XXIII) is a product of the reaction of a secondary amine with a glycerol triglycidyl ether. In the formula, $R_{46}$ and $R_{47}$ may be identical or different, and each represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms of $R_{46}+R_{47}$ is not less than 6 (specifically in the range of from 6 to 132). The two alkyl groups in the secondary amine used in the synthesis of this compound may have different numbers of carbon atoms.

(Reaction product of glycerol triglycidyl ether and a secondary amine)

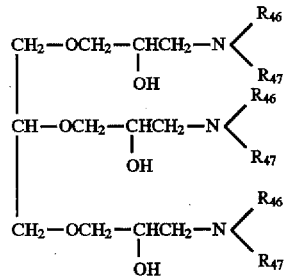

(XXIII)

Compound q (2) Compound "r" represented by formula (XXIV) is a product of the reaction of a secondary amine with a glycerol triglycidyl ether where a part of the epoxy groups of the glycerol triglycidyl ether remains unchanged. In the formula, $R_{48}$ and $R_{49}$ may be identical or different, and each represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms of $R_{48}+R_{49}$ is not less than 6 (specifically in the range of from 6 to 88). The two alkyl groups of the secondary amine used in the synthesis of this compound may have different numbers of carbon atoms.

(Partial reaction product of glycerol triglycidyl ether and a secondary amine)

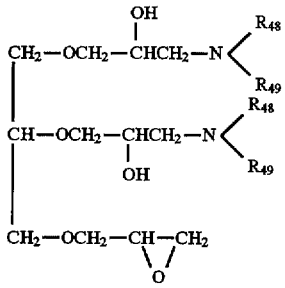

(XXIV)

Compound r (3) Compound "s" represented by formula (XXV) is a product of the reaction of a secondary amine with pentaerythritol tetraglycidyl ether. In the formula, $R_{50}$ and $R_{51}$ may be identical or different, and each represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms of $R_{50}+R_{51}$ is not less than 6 (specifically in the range of from 6 to 176). The two alkyl groups of the secondary amine used in the synthesis of this compound may have different numbers of carbon atoms.

(Reaction product of pentaerythritol tetraglycidyl ether and a secondary amine)

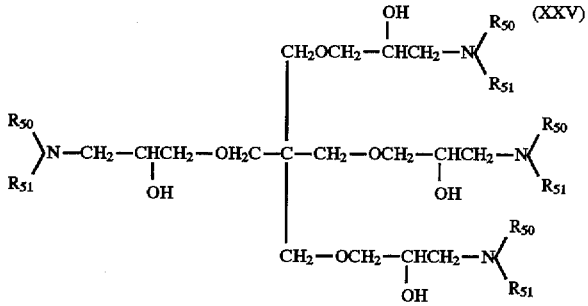

(XXV)

Compound s (4) Compound "t" represented by formula (XXVI) is a product of the reaction of a secondary amine with a pentaerythritol diglycidyl ether. In the formula, $R_{52}$ and $R_{53}$ may be identical or different, and each represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms of $R_{52}+R_{53}$ is not less than 6 (specifically in the range of from 6 to 88). The two alkyl groups of the secondary amine used in the synthesis of this compound may have different numbers of carbon atoms.

(Reaction product of pentaerythritol diglycidyl ether and a secondary amine)

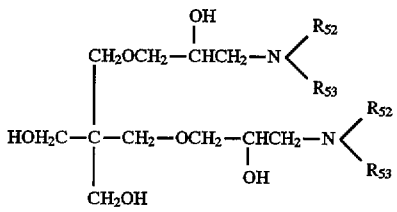

(XXVI)

Compound t (5) Compound "u" represented by formula (XXVII) is a product of the reaction of a secondary amine with trimethylolpropane triglycidyl ether. In the formula, $R_{54}$ and $R_{55}$ may be identical or different, and each represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms of $R_{54}+R_{55}$ is not less than 6 (specifically in the range of from 6 to 132). The two alkyl groups of the secondary amine used in the synthesis of this compound may have different numbers of carbon atoms.

(Reaction product of trimethylolpropane triglycidyl ether and a secondary amine)

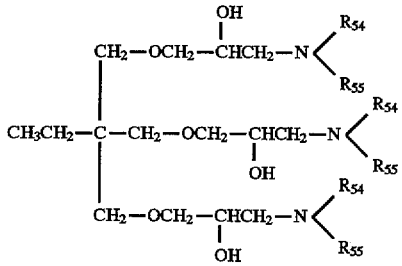

(XXVII)

Compound u (6) Compound "v" represented by formula (XXVIII) is a product of the reaction of a secondary amine with an ethylene glycol diglycidyl ether. In the formula, $R_{56}$ and $R_{57}$ may be identical or different, and each represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms of $R_{56}+R_{57}$ is not less than 6 (specifically in the range of from 6 to 88). The two alkyl groups of the secondary amine used in the synthesis of this compound may have different numbers of carbon atoms.

(Reaction product of ethylene glycol diglycidyl ether and a secondary amine)

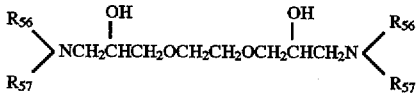

(XXVIII)

Compound v (7) Compound "w" represented by formula (XXIX) is a product of the reaction of a secondary amine with a propylene glycol diglycidyl ether. In the formula, $R_{58}$ and $R_{59}$ may be identical or different, and each represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms of $R_{58}+R_{59}$ is not less than 6 (specifically in the range of from 6 to 88). The two alkyl groups of the secondary amine used in the synthesis of this compound may have different numbers of carbon atoms.

(Reaction product of propylene glycol diglycidyl ether and a secondary amine)

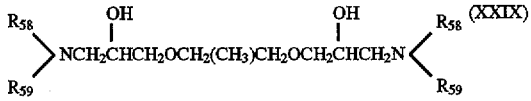

(XXIX)

Compound w (8) Compound "x" represented by formula (XXX) is a product of the reaction of a secondary amine with diglycidyl ether. In the formula, $R_{60}$ and $R_{61}$ may be identical or different, and each represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms of $R_{60}+R_{61}$ is not less than 6 (specifically in the range of from 6 to 88). The two alkyl groups of the secondary amine used in the synthesis of this compound may have different numbers of carbon atoms.

(Reaction product of diglycidyl ether and a secondary amine)

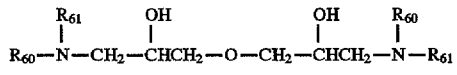

(XXX)

Compound x (9) Compound "y" represented by formula (XXXI) is a product of the reaction of a secondary amine with bisphenol A diglycidyl ether. In the formula, $R_{62}$ and $R_{63}$ may be identical or different, and each represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms of $R_{62}+R_{63}$ is not less than 6 (specifically in the range of from 6 to 88). The two alkyl groups of the secondary amine used in the synthesis of this compound may have different numbers of carbon atoms.

(Reaction product of bisphenol A diglycidyl ether and a secondary amine)

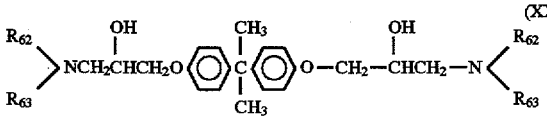

(XXXI)

Compound y

(10) Compound "z" represented by formula (XXXII) is a product of the reaction of a secondary amine with tartaric acid diglycidyl ester. In the formula, $R_{64}$ and $R_{65}$ may be identical or different, and each represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms of $R_{64}+R_{65}$ is not less than 6 (specifically in the range of from 6 to 88). The two alkyl groups of the secondary amine used in the synthesis of this compound may have different numbers of carbon atoms.

(Reaction product of tartaric acid diglycidyl ester and a secondary amine)

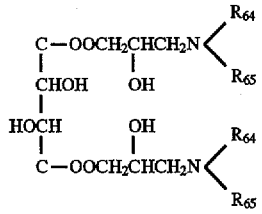

(XXXII)

Compound z

(11) Compound "α" represented by formula (XXXIII) is a product of the reaction of a secondary amine with malic acid diglycidyl ester. In the formula, $R_{66}$ and $R_{67}$ may be identical or different, and each represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms of $R_{66}+R_{67}$ is not less than 6 (specifically in the range of from 6 to 88). The two alkyl groups of the secondary amine used in the synthesis of this compound may have different numbers of carbon atoms.

(Reaction product of malic acid diglycidyl ester and a secondary amine)

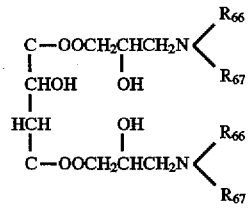

(XXXIII)

Compound α

(12) Compound "β" represented by formula (XXXIV) is a product of the reaction of a secondary amine with succinic acid diglycidyl ester. In the formula, $R_{68}$ and $R_{69}$ may be identical or different, and each represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms of $R_{68}+R_{69}$ is not less than 6 (specifically in the range of from 6 to 88). The two alkyl groups of the secondary amine used in the synthesis of this compound may have different numbers of carbon atoms.

(Reaction product of succinic acid diglycidyl ester and a secondary amine)

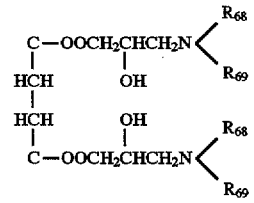

(XXXIV)

Compound β

(13) Compound "γ" represented by formula (XXXV) is a product of the reaction of a secondary amine with citric acid diglycidyl ester. In the formula, $R_{70}$ and $R_{71}$ may be identical or different, and each represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms of $R_{70}+R_{71}$ is not less than 6 (specifically in the range of from 6 to 132). The two alkyl groups of the secondary amine used in the synthesis of this compound may have different numbers of carbon atoms.

(Reaction product of citric acid triglycidyl ester and a secondary amine)

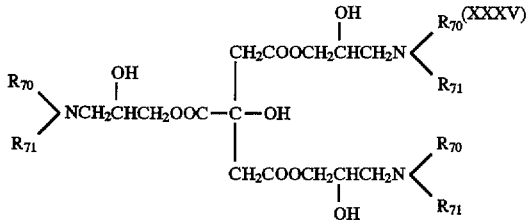

(XXXV)

Compound γ

(14) Compound "δ" represented by formula (XXXVI) is a product of the reaction of a secondary amine with trimellitic acid triglycidyl ester. In the formula, $R_{72}$ and $R_{73}$ may be identical or different, and each represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms. The total number of carbon atoms of $R_{72}+R_{73}$ is not less than 6 (specifically in the range of from 6 to 132). The two alkyl groups of the secondary amine used in the synthesis of this compound may have different numbers of carbon atoms.

(Reaction product of trimellitic acid triglycidyl ester and a secondary amine)

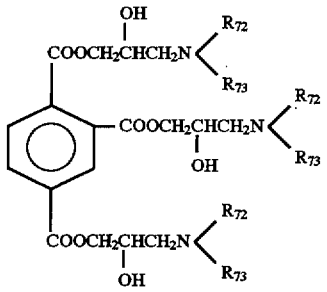

(XXXVI)

Compound δ

The amino alcohols presented above are examples suitably used in the present invention, but amino alcohols of the present invention are not limited to these examples. The dispersibility of water-containing calcium sulfate in oil can be increased by adding these amino alcohols to lubricating oils for diesel engines. Two or more amino alcohols may be combinedly used according to the conditions of the oil used, such as water content of inorganic substances in the oil.

Example schemes of the reaction by which an amino alcohol of the present invention is prepared are set forth below.

In the formulae, R, with or without having a hydroxyl group, represents a linear alkyl group having 1 to 22 carbon atoms, a linear alkenyl group having 2 to 22 carbon atoms, a branched alkyl or alkenyl group having 3 to 22 carbon atoms, an aryl group having 6 to 22 carbon atoms, or an aralkyl group having 7 to 22 carbon atoms; R' represents a linear alkyl group having 1 to 20 carbon atoms, a linear alkenyl group having 2 to 20 carbon atoms, a branched alkyl or alkenyl group having 3 to 20 carbon atoms, an aryl group having 6 to 20 carbon atoms, or an aralkyl group having 7 to 20 carbon atoms; n is a number of 0 to 20; and m is a number of 1 to 24. The total number of carbon atoms of R+R' is not less than 6.

Reaction scheme of a primary amine and an epoxy compound

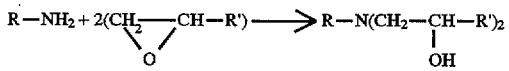

Reaction scheme of a secondary amine and an epoxy compound

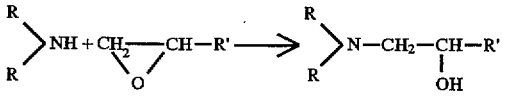

Reaction scheme of a polyalkylenepolyamine and an epoxy compound

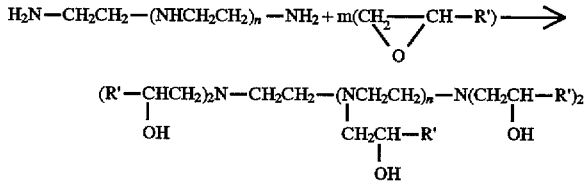

It is not necessary that all the nitrogen atoms are made to react with epoxy compounds.

Reaction Example (1): Reaction of a primary monoamine and an epoxy compound

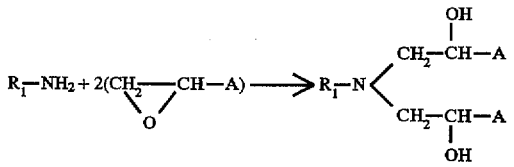

Reaction Example (2): Reaction of a secondary monoamine and an epoxy compound

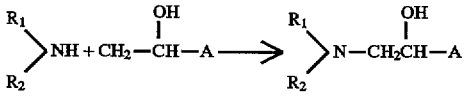

Reaction Example (3): Reaction of a polyethylenepolyimine and an epoxy compound

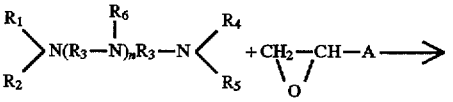

-continued

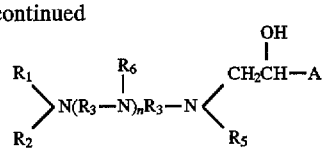

Reaction Example (4): Reaction of a glycidyl ether of polyhydric alcohol and a secondary amine

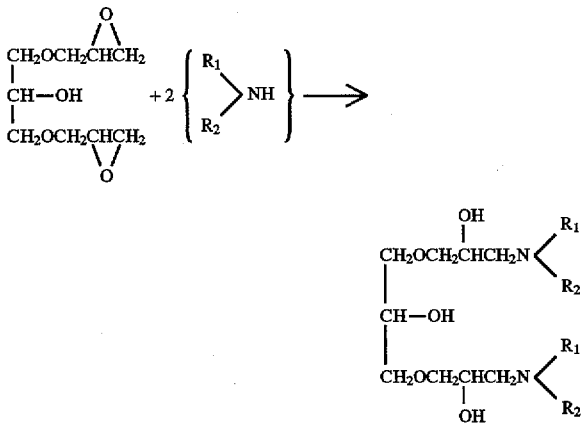

Reaction Example (5): Reaction of a glycidyl ester of a polybasic acid and a secondary amine

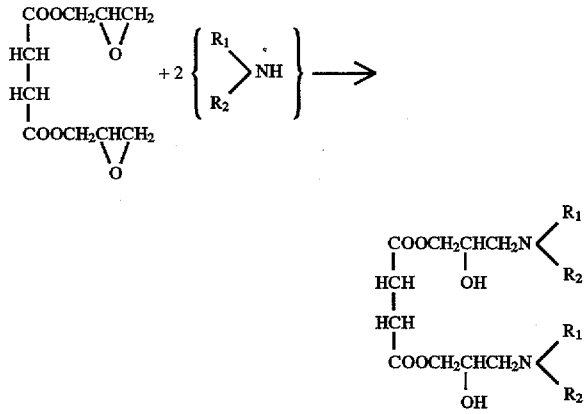

Reaction of an alkylalkylenediamine and an epoxy compound

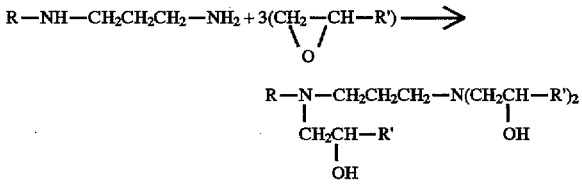

The above reactions can be carried out as follows:

First, a starting primary or secondary amine is stirred at a temperature of 80° C. or lower, preferably lower than room temperature, to which an epoxy compound is added dropwise. This reaction does not require a catalyst. When either of the starting materials, an amine or an epoxy compound, is in a solid state, it is dissolved in a solvent such as ethanol, toluene, xylene, hexane, and the like. The dropping speed of the epoxy compound is not limited, and may be adjusted so that the reaction temperature is in the above range. After the addition of the epoxy compound, the mixture is allowed to age for 3 to 8 hours. When a solvent is used, it is removed by a reduced pressure distillation to give a desired amino alcohol. The above mentioned reaction procedures and conditions can be similarly applied to all the reactions of a primary or secondary amine or a polyalkylene polyamine with an epoxy compound mentioned in the present specification.

In the amino alcohol of the present invention prepared as above, the hydroxyl groups formed by opening of epoxy rings are at the β-position to the nitrogen atoms, and therefore conjugated. Thus, the hydroxyl group becomes an adsorbing group having an effective chelating ability to metal salt sludge, thereby dispersing the sludge in oil. Since the amino alcohols of the present invention need to be soluble in lubricating oils for diesel engines, the total number of carbon atoms of the substituent group (R) on the nitrogen atom of the starting primary or secondary amine and the substituent group (R') of the starting epoxy compound is preferably not less than 6. The amino alcohols of the present invention added in an amount of 0.1 to 10% by weight, preferably 0.2 to 3.0% by weight of a lubricating oil for diesel engines can facilitate the dispersion of sludge in the oil and improve the deterging ability of the oil. When the amount is less than 0.1% by weight, the dispersing effect is reduced. Even when the amount exceeds 10% by weight, the corresponding extra effect cannot be achieved, causing economical disadvantages.

The present invention provides a method for dispersing water-containing calcium sulfate in an lubricating oil for diesel engines using an additive for lubricating oils for diesel engines, comprising the amino alcohols of the present invention. The present invention also provides a method for using a lubricating oil for diesel engines comprising adding an amino alcohol of the present invention as a dispersant for water-containing calcium sulfate in the lubricating oil for diesel engines. Specifically, the amino alcohols of the present invention is added to a lubricating oil for diesel engines in an amount of 0.1 to 10% by weight, preferably 0.2 to 3.0% by weight of the lubricating oil for diesel engines, thereby dispersing water-containing calcium sulfate formed in the lubricating oil for diesel engines, improving the deterging ability of the lubricating oil, and lengthening the duration of the life of the lubricating oil for diesel engines. In particular, the dispersing effect becomes remarkable when sulfur content in a fuel used in diesel engines is more than 0.5%.

Incidentally, products of a ring-opening reaction of an epoxy compound with a primary or secondary amine are in some cases used as rust preventives for lubricating oils (U.S. Pat. No. 4,762,628, EP-A-239536, U.S. Pat. No. 2,856,363). However, the additive for lubricating oils for diesel engines of the present invention is quite different from rust preventives. That is, the additives of the present invention are quite different from the above rust preventives in nature and have an ability of dispersing water-containing calcium sulfate in oil. The additives of the present invention can function based upon their unique chemical structures as mentions below.

Specifically, the amino alcohols of the present invention are characterized in that all the hydroxyl groups formed by the reaction of an epoxy compound with a primary or secondary amine are at the β-position to the nitrogen atom. As previously mentioned, the hydroxyl groups together with the nitrogen atom serve as a potent adsorbing group exerting a high chelating effect to metal sludges, thereby effectively trapping and dispersing inorganic substances such as calcium sulfate. Therefore, these compounds, when dissolved in oil, can achieve the effective dispersion of inorganic salts.

On the other hand, the rust preventives disclosed in the above references exert the rust preventive effect in the manner that the product of a ring-opening reaction of an epoxy compound with a primary or secondary amine is, as a whole, adsorbed onto the metal surface. This is quite different from the effect of the additive of the present invention which chelates to calcium sulfate and makes the calcium sulfate dispersible in oil. Also, the characteristic positioning of the hydroxyl group and the nitrogen atom of the present invention are not essential for the above rust preventives. The above references on the rust preventives do not mention at all that the effect and usefulness of the rust preventives are enhanced when the molecule of the compounds has two or more of the above characteristic structures. From this, it is understood that the integral structure of the molecule having only one such structure is needed for the rust preventive action.

The amino alcohols of the present invention can be used alone as an additive or in combination with metal-base detergents as a lubricating oil composition for diesel engines of the present invention. Any metal-base detergents which are conventionally used as additives for lubricating oil compositions for diesel engines can be used for the present invention. Examples of the metal-base detergents are neutral salts which are alkali earth metal salts of organic acids such as petroleum sulfonic acid (the metal-base detergents of this type are hereinafter referred to as "petroleum sulfonate metal-base detergents"), synthetic sulfonic acid, alkylphenol sulfide polymers (the metal-base detergents of this type are hereinafter referred to as "phenate metal-base detergents"), and alkyl salicylic acid (the metal-base detergents of this type are hereinafter referred to as "salicylate metal-base detergents"); and overbased compounds containing alkali earth metal carbonates.

The amount of the metal-base detergent to be added depends on the type of fuel used. It is normally 0.5 to 50% by weight. Preferably, it is added in an amount of 5.0 to 50% by weight of a lubricating oil for diesel engines of marine use, and 0.5 to 10% by weight of a lubricating oil for diesel engines of land use.

An ashless dispersant and an extreme-pressure lubricant may further be added to make a lubricating oil composition for diesel engines of the present invention.

The base oils used in the lubricating oil composition for diesel engines of the present invention are not limited, and any conventional base oils may be used. Mineral oils and synthetic oils, both having a viscosity of 20 to 250 $mm^2/sec$ at 40° C., may suitably be used. Here, "mineral oils" include paraffin hydrocarbons, aromatic hydrocarbons, and mixtures thereof. "Synthetic oils" include poly α-olefins, esters, and polyglycols.

The ashless dispersants usable for the lubricating oil composition for diesel engines are not limited, and any conventional dispersants are used. Amide compounds formed between carboxylic acid compounds and amines are generally used. A typical example of the amide compounds is alkenyl succinimide. The carboxylic acid compounds used here include polyolefin maleic anhydride derivatives, and fatty acids; and amines include polyamines, such as ethylenediamine, diethylenetriamine, triethylenetetramine, and tetraethylenepentamine. The ashless dispersant is added to the lubricating oil composition preferably in an amount of 0.1 to 10% by weight. Relatively higher amounts are needed to ensure high deterging effect.

The extreme-pressure lubricants usable in the present invention are not limited, and any known lubricants may be used. Suitable example of the extreme-pressure lubricating oils include zinc dialkyldithiophosphate, zinc alkylphosphate, alkali earth metal alkylphosphate, alkylphosphate, and fatty acid. The extreme-pressure lubricant is added to a lubricating oil composition for diesel engines preferably in an amount of 0.01 to 5% by weight.

To the lubricating oil composition for diesel engines of the present invention, the following additives may be added according to the requirements in the region and conditions in which the lubricating oil composition for diesel engines is used: pour point depressants and viscosity index improvers, each having a basic structure of lauryl methacrylate ester copolymers with a molecular weight of from 10000 to 100000; antioxidants such as tert-butylparacresol; metal deactivators such as triphenyl phosphite; and antifoaming agents of dimethyl silicone with viscosities of 10 to 100000 cSt at 25° C.

EXAMPLES

The present invention will be further described by means of Examples, without intending to restrict the scope of the present invention thereto.

Example 1

Detergency of lubricating oil compositions was evaluated using a hot tube tester shown in FIG. 1. Specifically, a lubricating oil were degraded in advance. The degraded lubricating oil and air were sent into a glass tube and heated to maintain a constant temperature, and adhesion of sludge due to degradation of the lubricating oil was observed and evaluated by the Racker scoring.

<Test Conditions>

Amount of oil: 6 ml/16 hours

Amount of air: 10 ml/minutes

Temperature of the heating area: 280° to 320° C.

<Pretreatment of Oil>

Assuming that the lubricating oil would be contaminated with acid substances (sulfuric acid), combustion products and abrasion powder during actual operation, each lubricating oil was degraded in advance with the substances as shown below. Specifically, carbon black, iron powder, and sulfuric acid were added to each lubricating oil in the amounts shown below and stirred at 100° C. for 10 minutes to prepare the test oils:

Carbon black: 0.2% by weight of a lubricating oil

Iron powder with a particle size of 5 μm or less:

0.05% by weight of a lubricating oil

Sulfuric acid: 0.8% by weight of a lubricating oil

<Evaluation Criteria>

The color of the glass tube after the 16-hour test was evaluated in comparison with the standard color, and given a score of:

1: Sludge is severely adhered to the glass tube, making the color of the tube black (blackly carbonized)

5: Sludge is moderately adhered to the glass tube, making the color of the tube light yellow 10: Sludge is very slightly adhere to the glass tube, making the color of the tube almost unchanged. The higher the score, the better the detergency.

<Composition of Oils>

Test oils were prepared by blending the amino alcohol of the present invention and other components listed in Tables 2 to 5 at the ratios shown in Table 1.

TABLE 1

| No. of Basic Composition | Amino alcohol*1 (% by weight) | Metal-base detergent*2 b1 | b2 | b3 | Ashless dispersant*3 (% by weight) | Extreme-pressure lubricant*4 (% by weight) | Base oil*5 |
|---|---|---|---|---|---|---|---|
| 1 | 0.5 | Adjust to 30 TBN | — | — | — | 0.5 | Balance |
| 2 | 0.5 | Adjust to 30 TBN | — | — | 1.5 | 0.5 | Balance |
| 3 | 0.5 | Adjust to 30 TBN | — | — | — | 0.5 | Balance |
| 4 | 0.5 | — | Adjust to 30 TBN | — | — | 0.5 | Balance |
| 5 | 0.5 | — | — | Adjust to 30 TBN | — | 0.5 | Balance |

*1: Specific compounds are listed in Tables 2 to 5.

*2: The alkalinity of the lubricating oil compositions were adjusted to 30TBN or 15TBN using commercially available products having the following alkalinities:

b1: Salicylate metal-base detergent =200 TBN

TBN (total base number): The term indicating alkalinity used in the field of art; 1TBN corresponds to 1 KOH mg/g, b2: Phenate metal-base detergent=170 TBN b3: Petroleum sulfonate metal-base detergent=227 TBN

*3: Polybutenyl succinimide (bis type)

*4: Zinc dithiophosphate (primary type)

*5: Natural mineral oil (120 cSt at 40° C.) (paraffin type) All the above materials are commercially available.

TABLE 2

| No. of Test Oils | Amino Alcohols (Starting compounds and their molar amounts used) | | Compounds | No. of Basic Composition |
|---|---|---|---|---|
| Inventive Products | 2 Monoethanolamine | 1 mol | e | 1 |
| | 1,2-Epoxydodecane | 2 mol | | |
| | 3 Diethanolamine | 1 mol | g | 1 |
| | 1,2-Epoxydodecane | 1 mol | | |
| | 4 Butylmonoethanolamine | 1 mol | g | 1 |
| | 1,2-Epoxydodecane | 1 mol | | |
| | 5 Hexylamine | 1 mol | e | 1 |
| | 1,2-Epoxydodecane | 2 mol | | |
| | 6 Octylamine | 1 mol | e | 1 |
| | 1,2-Epoxyethylbenzene | 2 mol | | |
| | 7 Laurylamine | 1 mol | e | 1 |
| | 1,2-Epoxyethylbenzene | 2 mol | | |
| | 8 Stearylamine | 1 mol | e | 1 |
| | 1,2-Epoxypropane | 2 mol | | |
| | 9 Stearylpropylenediamine | 1 mol | h | 1 |
| | 1,2-Epoxypropane | 3 mol | | |
| | 10 Ethylenediamine | 1 mol | h | 1 |
| | 1,2-Epoxydodecane | 4 mol | | |
| | 11 Diethylenetriamine | 1 mol | h | 1 |
| | 1,2-Epoxydodecane | 5 mol | | |
| | 15 Laurylamine | 1 mol | a | 1 |
| | 2,3-Epoxy-1-propanol | 2 mol | | |
| | 16 Laurylamine | 1 mol | a | 1 |
| | 2,3-Epoxy-1-propanol | 2 mol | | |
| | 17 Stearylamine | 1 mol | a | 1 |
| | 2,3-Epoxy-1-propanol | 2 mol | | |

TABLE 3

| No. of Test Oils | Amino Alcohols (Starting compounds and their molar amounts used) | | Compounds | No. of Basic Composition |
|---|---|---|---|---|
| Inventive Products | 18 Laurylamine | 1 mol | e | 1 |
| | 1,2-Epoxydodecane | 2 mol | | |
| | 19 Stearylamine | 1 mol | e | 1 |
| | 1,2-Epoxydodecane | 2 mol | | |
| | 20 Stearylamine | 1 mol | e | 1 |
| | 1,2-Epoxybutane | 2 mol | | |
| | 22 Monoethanolamine | 1 mol | e | 2 |
| | 1,2-Epoxydodecane | | | |
| | 23 Diethanolamine | 1 mol | g | 2 |
| | 1,2-Epoxydodecane | 1 mol | | |
| | 24 Butylmonoethanolamine | 1 mol | g | 2 |
| | 1,2-Epoxydodecane | 1 mol | | |
| | 25 Hexylamine | 1 mol | e | 2 |
| | 1,2-Epoxydodecane | 2 mol | | |
| | 26 Octylamine | 1 mol | e | 2 |
| | 1,2-Epoxyethylbenzene | 2 mol | | |
| | 27 Laurylamine | 1 mol | e | 2 |
| | 1,2-Epoxyethylbenzene | 2 mol | | |
| | 28 Stearylamine | 1 mol | e | 2 |
| | 1,2-Epoxypropane | 2 mol | | |
| | 30 Laurylamine | 1 mol | e | 3 |
| | 1,2-Epoxyethylbenzene | 2 mol | | |
| | 31 Stearylamine | 1 mol | e | 3 |
| | 1,2-Epoxypropane | 2 mol | | |
| | 33 Laurylamine | 1 mol | e | 4 |
| | 1,2-Epoxyethylbenzene | 2 mol | | |
| | 34 Stearylamine | 1 mol | e | 4 |
| | 1,2-Epoxypropane | 2 mol | | |
| | 36 Laurylamine | 1 mol | e | 5 |
| | 1,2-Epoxyethylbenzene | 2 mol | | |
| | 37 Stearylamine | 1 mol | e | 5 |
| | 1,2-Epoxypropane | 2 mol | | |

TABLE 4

| No. of Test Oils | Amino Alcohols (Starting compounds and their molar amounts used) | Compounds | No. of Basic Composition |
|---|---|---|---|
| Inventive Products | 38 Ethylenediamine (1 mol); Lauryl glycidyl ether (4 mol) | 1 | 1 |
| | 39 Ethylenetriamine (1 mol); Lauryl glycidyl ether (4 mol) | 1 | 1 |
| | 40 Diethylenetriamine (1 mol); Lauryl glycidyl ether (2 mol); 1,2-Epoxypropanol (2 mol) | 1 | 1 |

TABLE 4-continued

| No. of Test Oils | Amino Alcohols (Starting compounds and their molar amounts used) | Compounds | No. of Basic Composition |
|---|---|---|---|
| 41 | Triethylenetriamine (1 mol); Oleyl glycidyl ether (2 mol); Phenol glycidyl ether (2 mol) | l | 1 |
| 42 | Monolaurylamine (1 mol); Phenol glycidyl ether (2 mol) | i | 1 |
| 43 | Monoethanolamine (1 mol); Oleyl glycidyl ether (2 mol) | i | 1 |
| 44 | Monoethylamine (1 mol); Oleyl glylcidyl ether (2 mol) | i | 1 |
| 45 | Dioctylamine (2 mol); Ethylene glycol glycidyl ether (1 mol) | q | 1 |
| 46 | Monooleylamine (1 mol); 2-Ethylhexyl glycidyl ester (2 mol) | m | 1 |
| 47 | Mmonooleylamine (1 mol); Acetic acid glycidyl ester (2 mol) | m | 1 |
| 48 | Ethylenediamine (1 mol); Oleyl glycidyl ester (4 mol) | p | 1 |
| 49 | Glycerol triglycidyl ether (1 mol); Dilaurylamine (3 mol) | q | 1 |
| 50 | Pentaerythritol tetraglycidyl Ether (1 mol); Dilaurylamine (4 mol) | q | 1 |
| 51 | Succinic acid diglycidyl ester (1 mol); Dilaurylamine (2 mol) | q | 1 |
| 52 | Citric acid triglycidyl ester (1 mol); Dilaurylamine (3 mol) | q | 1 |
| 87 | Diethanolamine (1 mol); Dodecyl glycidyl ether (1 mol) | k | 1 |
| 88 | Diethanolamine (1 mol); Dodecyl glycidyl ether (1 mol) | k | 2 |
| 89 | Diethanolamine (1 mol); Lauryl glycidyl ester (1 mol) | o | 1 |
| 90 | Diethanolamine (1 mol); Lauryl glycidyl ester (1 mol) | o | 2 |

TABLE 5

| No. of Test Oils | | Amino Alcohols (Starting compounds and their molar amounts used) | Compounds | No. of Basic Composition |
|---|---|---|---|---|
| Comparative Products | 1 | Not added | | 1 |
| | 21 | Not added | | 2 |
| | 29 | Not added | | 3 |
| | 32 | Not added | | 4 |
| | 35 | Not added | | 5 |
| | 94* | Mono-n-dodecylamine | — | 1 |
| | 95* | Mono-n-dodecylamine | — | 2 |
| | 96* | Mono-n-octadecylamine | — | 1 |
| | 97* | n-dodecyl alcohol | — | 1 |

*A comparative compound was added in place of an amino alcohol.

<Results>

The results are shown in Tables 6 and 7.

TABLE 6

| No. of Test Oils | | Temperatures (°C.) of Hot Tube Test and Detergency Scores | | | | |
|---|---|---|---|---|---|---|
| | | 280 | 290 | 300 | 310 | 320 |
| Inventive Products | 2 | 9.0 | 9.0 | 8.0 | 6.0 | 5.0 |
| | 3 | 9.0 | 9.0 | 8.0 | 6.5 | 5.5 |
| | 4 | 9.5 | 9.5 | 8.5 | 5.5 | 5.5 |
| | 5 | 9.5 | 9.5 | 9.0 | 7.0 | 6.5 |

TABLE 6-continued

| No. of Test Oils | | Temperatures (°C.) of Hot Tube Test and Detergency Scores | | | | |
|---|---|---|---|---|---|---|
| | | 280 | 290 | 300 | 310 | 320 |
| | 6 | 9.5 | 9.5 | 9.5 | 7.5 | 6.5 |
| | 7 | 10.0 | 9.5 | 9.0 | 7.5 | 6.0 |
| | 8 | 10.0 | 10.0 | 9.5 | 8.0 | 7.0 |
| | 9 | 9.5 | 9.5 | 8.5 | 7.5 | 6.0 |
| | 10 | 9.0 | 9.0 | 8.0 | 7.0 | 5.0 |
| | 11 | 9.5 | 9.5 | 8.0 | 7.5 | 5.5 |
| | 12 | 9.5 | 9.5 | 8.0 | 7.5 | 6.5 |
| | 13 | 9.5 | 9.5 | 8.5 | 7.5 | 6.5 |
| | 14 | 10.0 | 10.0 | 10.0 | 9.0 | 7.5 |
| | 15 | 10.0 | 10.0 | 10.0 | 8.0 | 7.5 |
| | 16 | 10.0 | 9.5 | 9.0 | 8.0 | 7.0 |
| | 17 | 10.0 | 10.0 | 10.0 | 8.5 | 7.0 |
| | 18 | 10.0 | 10.0 | 10.0 | 8.0 | 7.5 |
| | 19 | 10.0 | 9.5 | 8.0 | 7.0 | 6.0 |
| | 20 | 10.0 | 10.0 | 10.0 | 8.5 | 7.0 |
| | 22 | 9.0 | 8.5 | 8.0 | 6.5 | 5.5 |
| | 23 | 9.5 | 9.0 | 8.0 | 6.0 | 5.5 |
| | 24 | 9.5 | 9.5 | 8.5 | 6.5 | 5.5 |
| | 25 | 9.5 | 9.5 | 9.0 | 7.0 | 6.5 |
| | 26 | 9.5 | 9.0 | 8.0 | 7.5 | 6.5 |
| | 27 | 10.0 | 9.5 | 9.0 | 7.5 | 6.0 |
| | 28 | 10.0 | 10.0 | 9.5 | 8.0 | 7.0 |
| | 30 | 9.5 | 9.5 | 9.5 | 8.0 | 6.0 |
| | 31 | 9.5 | 9.5 | 9.5 | 8.0 | 6.0 |
| | 33 | 9.0 | 9.0 | 8.0 | 6.0 | 5.5 |
| | 34 | 9.0 | 9.0 | 7.5 | 6.0 | 5.5 |
| | 36 | 9.0 | 9.0 | 8.0 | 6.5 | 6.0 |
| | 37 | 9.0 | 9.0 | 7.0 | 6.0 | 6.0 |
| Comparative Products | 1 | 8.0 | 7.0 | 5.5 | 2.0 | 1.0 |
| | 21 | 8.5 | 7.5 | 6.0 | 2.0 | 1.0 |
| | 29 | 7.0 | 6.0 | 4.0 | 2.0 | 1.0 |
| | 32 | 8.0 | 5.0 | 2.0~2.5 | 1.5 | 1.0 |
| | 35 | 8.0 | 3.5 | 1.5 | 1.0 | 1.0 |

TABLE 7

| No. of Test Oils | | Temperatures (°C.) of Hot Tube Test and Detergency Scores | | | | |
|---|---|---|---|---|---|---|
| | | 280 | 290 | 300 | 310 | 320 |
| Inventive Products | 38 | 10.0 | 9.5 | 9.0 | 8.0 | 6.5 |
| | 39 | 10.0 | 9.5 | 9.0 | 8.0 | 6.5 |
| | 40 | 10.0 | 9.5 | 9.0 | 8.5 | 6.5 |
| | 41 | 10.0 | 9.5 | 9.5 | 8.0 | 6.5 |
| | 42 | 10.0 | 9.0 | 9.0 | 7.5 | 6.5 |
| | 43 | 10.0 | 9.5 | 9.0 | 8.0 | 6.0 |
| | 44 | 10.0 | 9.5 | 9.0 | 8.0 | 6.0 |
| | 45 | 10.0 | 9.5 | 9.0 | 8.0 | 6.0 |
| | 46 | 10.0 | 9.5 | 9.0 | 8.0 | 6.0 |
| | 47 | 10.0 | 9.0 | 8.5 | 7.5 | 6.0 |
| | 48 | 10.0 | 9.5 | 9.0 | 7.5 | 5.5 |
| | 49 | 9.5 | 9.0 | 8.5 | 8.0 | 6.0 |
| | 50 | 10.0 | 9.0 | 8.5 | 8.0 | 6.5 |
| | 51 | 9.5 | 9.0 | 8.5 | 7.5 | 6.0 |
| | 52 | 10.0 | 9.0 | 8.5 | 8.0 | 5.5 |
| | 87 | 9.5 | 9.5 | 9.5 | 9.0 | 7.5 |
| | 88 | 10.0 | 10.0 | 9.5 | 9.0 | 7.5 |
| | 89 | 9.5 | 9.5 | 9.5 | 8.5 | 7.0 |
| | 90 | 10.0 | 10.0 | 9.5 | 9.0 | 7.0 |
| Comparative Products | 94 | 7.5 | 6.0 | 5.0 | 1.5 | 1.0 |
| | 95 | 7.5 | 6.0 | 5.5 | 2.0 | 1.0 |
| | 96 | 8.0 | 7.0 | 6.0 | 2.0 | 1.0 |
| | 97 | 8.0 | 7.0 | 5.0 | 2.0 | 1.0 |

It is obvious from the results in Tables 6 and 7 that the detergency of the lubricating oils to which the amino alcohols of the present invention were added was improved. In particular, detergency at high temperatures (300° to 320° C.) was significantly improved. Also, the amino alcohols of the present invention exerted their effect regardless of the type of metal-base detergents used together, and the amounts of metal-base detergents and ashless dispersants can be reduced.

Example 2

The detergency of lubricating oils for the piston was evaluated using a four-cylinder engine manufactured by Nissan Motor, Co., Ltd. The fuel used was a mixture of fuel oil A and light oil (1:1), sulfur content of which was adjusted equal to that of fuel oil C (3%) using DBDS (di-t-butylsulfide).

Details of test conditions and type of the engine used are set forth below:

<Engine>

Type: 4 cycles, 4 cylinders, water-cooling diesel engine

Cubic capacity: 2.2 liters

Combustion system: Ante-chamber type

Bore×Stroke: 80×83.6 mm

Compression ratio: 22.2

<Operation Conditions of Engine>

Test operation duration: 100 hours

Engine RPM: 3000 rpm

Fuel: fuel oil A/light oil (1:1)+DBDS (S=3%)

<Site and Criteria for Detergency Evaluation>

Figure 2:
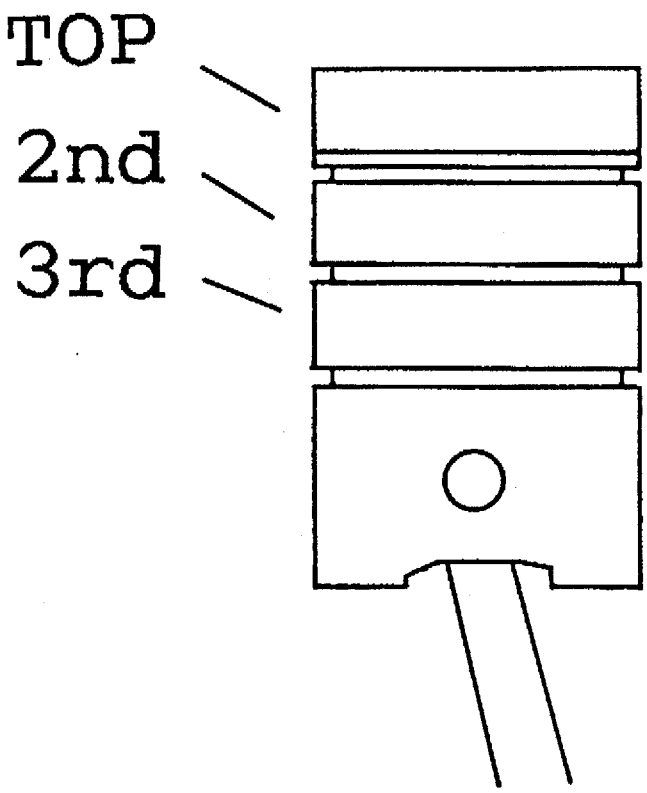
FIG. 2 is a schematic view of a piston to indicate the sites for detergency evaluation in Example 2.

Evaluation site: Piston land (TOP, 2nd, and 3rd, as shown in FIG. 2)

Evaluation criteria: The fouling condition around the piston land was evaluated according to the following criteria:

F: Deposition of carbon is found (almost over the whole surface)

E: Deposition of carbon is found (covering ⅓ or more area in the direction of the piston circumference)

D: Deposition of carbon is found (covering ⅓ or less area in the direction of the piston circumference)

C: Light yellow coloration is found (covering ⅓ or more area in the direction of the piston circumference)

B: Light yellow coloration is found (covering ⅓ or less area in the direction of the piston circumference)

A: No coloration

<Test oils>

Test oils listed in Table 8 were used. Oils prepared in Example 3 were used as Test oils 72, 73, 78, 79, 80, and 84.

<Results>

The results are shown in Table 8. The results clearly indicate that the lubricating oil composition comprising an amino alcohol of the present invention has a significantly improved detergency for the piston.

Since the piston land is directly contacted with combustion gas, it is likely to get fouled with carbon sludge. Therefore, upon evaluation of the detergency for the piston, the sludge deposition on the lower part (2nd and 3rd parts) of the piston is important. It is noted that the lubricating oil composition of the present invention is particularly effective in deterging the sludge on the 2nd and 3rd parts. Sufficient deterging effect for the piston was observed with only 0.5% addition of the amino alcohol of the present invention.

TABLE 8

| No. of Test Oils | | Sites and Results of Evaluation TOP | 2nd | 3rd |
|---|---|---|---|---|
| Inventive Products | 3 | C~D | A | A |
| | 7 | D~E | B | A |
| | 8 | D~E | A~B | A |
| | 23 | C | A | A |
| | 27 | D | A~B | A |
| | 28 | D | A~B | A |
| | 30 | D~E | C | A |
| | 31 | D~E | B | A |
| | 33 | D~E | B~C | A |
| | 34 | D~E | B~C | A |
| | 36 | D~E | B~C | A~B |
| | 37 | D~E | B~C | A~B |
| | 72 | D | B | A |
| | 73 | D~E | C | A |
| | 78 | D | B | A |
| | 79 | D | B | A |
| | 80 | D | B | A |
| | 84 | D | A~B | A |
| | 87 | C~D | A | A |
| | 88 | C~D | A | A |
| | 89 | C~D | A~B | A |
| | 90 | C~D | A | A |

TABLE 9

| No. of Test Oils | | Sites and Results of Evaluation TOP | 2nd | 3rd |
|---|---|---|---|---|
| Comparative Products | 1 | E | D | B |
| | 21 | E | D | B |
| | 29 | F | D~E | C |
| | 32 | E~F | D~E | B |
| | 35 | E~F | E | C |
| | 94 | F | D~E | C |
| | 95 | F | D~E | C |
| | 96 | E~F | D | C |
| | 97 | F | E | B |

Example 3

The effect of dispersing water-containing calcium sulfate in oil was tested. In the test, dispersion state of calcium sulfate was observed, using lubricating oil compositions (test oils listed in Tables 10 to 14) which were adjusted at 30 TBN with a metal-base detergent (calcium salicylate). Specifically, 60% aqueous solution of sulfuric acid was added to each test oil, and stirred for a given period of time to form calcium sulfate. The dispersion state of the calcium sulfate formed was visually observed. The calcium sulfate formed owing to sulfuric acid contamination readily absorbs water. Therefore, by using sulfuric acid which is diluted with water in advance, water-containing calcium sulfate (theoretical water content=3.63 mol/l mol of $CaSO_4$) can easily be formed.

<Test Conditions>

1) In a test tube with internal diameter of 30 mm, 50 g of each test oil was placed, to which sulfuric acid diluted at 60% with water in advance was added in the amount (0.65 g/50 g of oil) to neutralize the oil by 9 TBN (KOH mg/g).
2) Next, the test tube was heated to 50° C. and stirred with a stirrer (flat type stirring blade: 120 mm×18 mm) for 10 minutes.
3) After the stirring, the test tube was allowed to stand for 30 minutes at 50° C., and then oil-dispersibility of calcium sulfate was visually evaluated.

<Evaluation Method>

A: Calcium sulfate is dispersed in the oil without showing adhesion to the wall or precipitation.

B: A part (about ⅓) of calcium sulfate adheres to the wall or precipitates, with the remaining being dispersed in the oil.

C: A half or more of calcium sulfate adheres to the wall or precipitates, with the remaining being dispersed in the oil.

D: All of calcium sulfate adheres to the wall or precipitates.

<Results>

The results are shown in Tables 10 to 14. The results are summarized as follows:

(1) The dispersibility of calcium sulfate in oil was tested with several amounts of the amino alcohols of the present invention in the range of from 0.05 to 5% by weight. As a result, it was found that dispersibility of calcium sulfate in oil was low at 0.05% by weight, and became noticeable at 0.1% by weight and remarkable at 0.15% by weight or higher (Inventive Products 53 to 58, and 91 to 93).

(2) The effect of the amino alcohols of the present invention was evaluated with lubricating oil compositions containing no ashless dispersant and no extreme-pressure lubricant. The addition of the amino alcohol of the present invention by itself provided the lubricating oil compositions with a satisfactory dispersing action. The effect achieved was comparable to that achieved by the lubricating oil composition to which an ashless dispersant and extreme-pressure lubricant were further added (Inventive Products 55 and 57).

(3) Ashless dispersants conventionally used for lubricating oils for diesel engines alone did not show noticeable effect of dispersing water-containing calcium sulfate, and calcium sulfate aggregated to form large particles during stirring and was deposited on the wall and bottom of the vessel (Comparative Products 101 and 102). Also, there observed almost no dispersing effect with amines having no hydroxyl group or alcohols having no amino group. From this, it is known that amino alcohols with the characteristic structure exert the excellent dispersing effect.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

TABLE 10

| No. of Test Oils | | Amino Alcohols and Amounts | (% by weight) | Basic Structure | Metal-base Detergent (% by weight) | Ashless Dispersant (% by weight) | Extreme-pressure Lubricant (% by weight) | Mineral Oil (% by weight) | Evaluation Results |
|---|---|---|---|---|---|---|---|---|---|
| Comparative Products | 101 | Not added | | | 15 | 1.5 | 0.5 | Balance | D |
| | 102 | Not added | | | 15 | 1.5 | 0.5 | Balance | D |
| Inventive Products | 53 | Reaction product of diethanolamine (1 mol) and 1,2-epoxydodecane (1 mol) | 0.05 | g | 15 | 1.5 | 0.5 | Balance | C |
| | 91 | Reaction product of diethanolamine (1 mol) and 1,2-epoxydodecane (1 mol) | 0.15 | g | 15 | 1.5 | 0.5 | Balance | A |
| | 92 | Reaction product of diethanolamine (1 mol) and dodecyl glycidyl ether (1 mol) | 0.15 | k | 15 | 1.5 | 0.5 | Balance | A |
| | 93 | Reaction product of diethanolamine (1 mol) and lauric acid glycidyl ester (1 mol) | 0.15 | o | 15 | 1.5 | 0.5 | Balance | A |
| | 54 | Reaction product of diethanolamine (1 mol) and 1,2-epoxydodecane (2 mol) | 0.25 | g | 15 | 1.5 | 0.5 | Balance | A~B |
| | 55 | Reaction product of diethanolamine (1 mol) and 1,2-epoxydodecane (2 mol) | 0.50 | g | 15 | 1.5 | 0.5 | Balance | A |
| | 56 | Reaction product of diethanolamine (1 mol) and 1,2-epoxydodecane (2 mol) | 5.0 | g | 15 | 1.5 | 0.5 | Balance | A |
| | 57 | Reaction product of diethanolamine (1 mol) and 1,2-epoxydodecane (2 mol) | 0.50 | g | 15 | 0 | 0 | Balance | A |
| | 58 | Reaction product of dilaurylamine (1 mol) and 1,2-epoxypropanol (1 mol) | 0.50 | c | 15 | 0 | 0 | Balance | A |

Materials used:
Metal-base detergent = commercially available salicylate metal-base detergent (calcium salt product of 200 TBN)
Ashless detergent = commercially available alkyl(polybutenyl) succinimide(bis type)
Extreme-pressure lubricant = commercially available alkyl (No. of carbon atoms ÷ 8, primary type) zinc phosphate
Base oil (mineral oil) = commercially available natural paraffin mineral oil (120 cSt/40° C.)

TABLE 11

| No. of Test Oils | | Amino Alcohols and Amounts | (% by weight) | Basic Structure | Metal-base Detergent (% by weight) | Ashless Dispersant (% by weight) | Extreme-pressure Lubricant (% by weight) | Mineral Oil (% by weight) | Evaluation Results |
|---|---|---|---|---|---|---|---|---|---|
| Inventive Products | 50 | Reaction product of monooleylamine (1 mol) and 1,2-epoxypropanol (2 mol) | 0.50 | a | 15 | 0 | 0 | Balance | A |
| | 60 | Reaction product of ethylenediamine (1 mol) and 1,2-epoxyoctane (3 mol) | 0.50 | h | 15 | 0 | 0 | Balance | A |

TABLE 11-continued

| No. of Test Oils | Amino Alcohols and Amounts | (% by weight) | Basic Structure | Metal-base Detergent (% by weight) | Ashless Dispersant (% by weight) | Extreme-pressure Lubricant (% by weight) | Mineral Oil (% by weight) | Evaluation Results |
|---|---|---|---|---|---|---|---|---|
| 61 | Reaction product of stearylpropylene diamine (1 mol) and 1,2-epoxypropanol (3 mol) | 0.50 | d | 15 | 3.0 | 0.5 | Balance | A |
| 62 | Reaction product of monolaurylamine (1 mol) and 1,2-epoxyoctane (2 mol) | 0.50 | e | 15 | 3.0 | 0.5 | Balance | A |
| 63 | Reaction product of monostearylamine (1 mol) and phenyl glycidyl ether (2 mol) | 0.50 | i | 15 | 3.0 | 0.5 | Balance | A |
| 64 | Reaction product of diethylene-triamine (1 mol) and nonylphenol glycidyl ether (4 mol) | 0.50 | l | 15 | 3.0 | 0.5 | Balance | A |
| 65 | Reaction product of dibehenylamine (1 mol) and ethylene glycol glycidyl ether (1 mol) | 0.50 | k | 15 | 3.0 | 0.5 | Balance | A |
| 66 | Reaction product of monooleylamine (1 mol) and 2-ethylhexyl glycidyl ester (2 mol) | 0.50 | m | 15 | 3.0 | 0.5 | Balance | A |

Materials used:
Metal-base detergent = commercially available salicylate metal-base detergent (calcium salt product of 200 TBN)
Ashless detergent = commercially available alkyl(polybutenyl) succinimide(bis type)
Extreme-pressure lubricant = commercially available alkyl (No. of carbon atoms ÷ 8, primary type) zinc phosphate
Base oil (mineral oil) = commercially available natural paraffin mineral oil (120 cSt/40° C.)

TABLE 12

| No. of Test Oils | Amino Alcohols and Amounts | (% by weight) | Basic Structure | Metal-base Detergent (% by weight) | Ashless Dispersant (% by weight) | Extreme-pressure Lubricant (% by weight) | Mineral Oil (% by weight) | Evaluation Results |
|---|---|---|---|---|---|---|---|---|
| Inventive Products 67 | Reaction product of dioleylamine (1 mol) and caproic acid glycidyl ester (1 mol) | 0.50 | o | 15 | 3.0 | 0.5 | Balance | A |
| 68 | Reaction product of ethylenediamine (1 mol) and oleic acid glycidyl ester (4 mol) | 0.50 | p | 15 | 1.5 | 0.5 | Balance | A |
| 69 | Reaction product of dioleylamine (2 mol) and diglycidyl ether (1 mol) | 0.50 | x | 15 | 1.5 | 0.5 | Balance | A |
| 70 | Reaction product of citric acid tri-glycidyl ester (1 mol) and dioctyl-amine (3 mol) | 0.50 | γ | 15 | 1.5 | 0.5 | Balance | A |
| 71 | Reaction product of succinic acid diglycidyl ester (1 mol) and dioctyl-amine (2 mol) | 0.50 | β | 15 | 1.5 | 0.5 | Balance | A |
| 72 | Reaction product of dioleylamine (4 mol) and pentaerythritol tetra-glycidyl ether (1 mol) | 0.50 | s | 15 | 1.5 | 0.5 | Balance | A |
| 73 | Reaction product of dioleylamine (3 mol) and glycerol triglycdiyl ether (1 mol) | 0.50 | q | 15 | 1.5 | 0.5 | Balance | A |

Materials used:
Metal-base detergent = commercially available salicylate metal-base detergent (calcium salt product of 200 TBN)
Ashless detergent = commercially available alkyl(polybutenyl) succinimide(bis type)
Extreme-pressure lubricant = commercially available alkyl (No. of carbon atoms ÷ 8, primary type) zinc phosphate
Base oil (mineral oil) = commercially available natural paraffin mineral oil (120 cSt/40° C.)

TABLE 13

| No. of Test Oils | Amino Alcohols and Amounts | (% by weight) | Basic Structure | Metal-base Detergent (% by weight) | Ashless Dispersant (% by weight) | Extreme-pressure Lubricant (% by weight) | Mineral Oil (% by weight) | Evaluation Results |
|---|---|---|---|---|---|---|---|---|
| Comparative Products 103 | Not added | | | 15 | 0 | 0 | Balance | D |
| 104 | Not added | | | 15 | 3.0 | 0.5 | Balance | D |
| Inventive 74 | Reaction product of stearylamine | 1.00 | i | 15 | 0 | 0 | Balance | A |

TABLE 13-continued

| No. of Test Oils | | Amino Alcohols and Amounts | (% by weight) | Basic Structure | Metal-base Detergent (% by weight) | Ashless Dispersant (% by weight) | Extreme-pressure Lubricant (% by weight) | Mineral Oil (% by weight) | Evaluation Results |
|---|---|---|---|---|---|---|---|---|---|
| Products | | (1 mol) and phenol glycidyl ether (2 mol) | | | | | | | |
| | 75 | Reaction product of oleylamine (1 mol) and 1,2-epoxypropanol (2 mol) | 1.00 | a | 15 | 0 | 0 | Balance | A |
| | 76 | Reaction product of oleylamine (1 mol) and nonylphenol glycidyl ether (2 mol) | 1.00 | i | 15 | 0 | 0 | Balance | A |
| | 77 | Reaction product of laurylamine (2 mol) and diglycidyl ether (0.8 mol) | 1.00 | x | 15 | 3.0 | 0.5 | Balance | A |
| | 78 | Reaction product of ethylene glycol diglycidyl ether (1 mol) and dioctylamine ( 2mol) | 1.00 | v | 15 | 1.5 | 0.5 | Balance | A |
| | 79 | Reaction product of glycerol triglycidyl ether (1 mol) and dioctylamine (3 mol) | 1.00 | q | 15 | 1.5 | 0.5 | Balance | A |

Materials used:
Metal-base detergent = commercially available salicylate metal-base detergent (calcium salt product of 200 TBN)
Ashless detergent = commercially available alkyl(polybutenyl) succinimide(bis type)
Extreme-pressure lubricant = commercially available alkyl (No. of carbon atoms ÷ 8, primary type) zinc phosphate
Base oil (mineral oil) = commercially available natural paraffin mineral oil (120 cSt/40° C.)

TABLE 14

| No. of Test Oils | | Amino Alcohols and Amounts | (% by weight) | Basic Structure | Metal-base Detergent (% by weight) | Ashless Dispersant (% by weight) | Extreme-pressure Lubricant (% by weight) | Mineral Oil (% by weight) | Evaluation Results |
|---|---|---|---|---|---|---|---|---|---|
| Comparative Products | 105 | Mono-n-dodecylamine | 1.00 | | 15 | 1.5 | 0.5 | Balance | D |
| | 106 | Mono-n-octadecylamine | 1.00 | | 15 | 1.5 | 0.5 | Balance | D |
| | 107 | n-dodecylalcohol | 1.00 | | 15 | 1.5 | 0.5 | Balance | D |
| Inventive Products | 80 | Reaction product of glycerol monoglycidyl ether (1 mol) and dioctylamine (1 mol) | 1.00 | c | 15 | 1.5 | 0.5 | Balance | A |
| | 81 | Reaction product of glycerol diglycidyl ether (1 mol) and dioctylamine (2 mol) | 1.00 | | 15 | 1.5 | 0.5 | Balance | A |
| | 82 | Reaction product of pentaerythritol tetraglycidyl ether (1 mol) and dioctylamine (4 mol) | 1.00 | s | 15 | 1.5 | 0.5 | Balance | A |
| | 83 | Reaction product of pentaerythritol monoglycidyl ether (1 mol) and dioctylamine (1 mol) | 1.00 | c | 15 | 1.5 | 0.5 | Balance | A |
| | 84 | Reaction product of succinic acid diglycidyl ester (1 mol) and dioctylamine (2 mol) | 1.00 | β | 15 | 1.5 | 0.5 | Balance | A |
| | 85 | Reaction product of tartaric acid diglycidyl ester (1 mol) and dioctylamine (2 mol) | 1.00 | z | 15 | 1.5 | 0.5 | Balance | A |
| | 86 | Reaction product of citric acid triglycidyl ester (1 mol) and dioctylamine (3 mol) | 1.00 | γ | 15 | 1.5 | 0.5 | Balance | A |

Materials used:
Metal-base detergent = commercially available salicylate metal-base detergent (calcium salt product of 200 TBN)
Ashless detergent = commercially available alkyl(polybutenyl) succinimide(bis type)
Extreme-pressure lubricant = commercially available alkyl (No. of carbon atoms ÷ 8, primary type) zinc phosphate
Base oil (mineral oil) = commercially available natural paraffin mineral oil (120 cSt/40° C.)

What is claimed is:

1. A method for dispersing water-containing calcium sulfate in a lubricating oil for diesel engines, comprising adding to a base oil one or more of the additives for lubricating oils for diesel engines having the formula XXXVII:

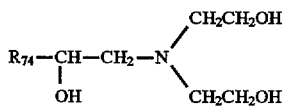

(XXXVII)

where $R_{74}$ is a linear or branched alkyl group having 10 to 14 carbon atoms.

2. The method according to claim 1, wherein the amount of said additive is from 0.1 to 10% by weight.

3. In a process for using a lubricating oil for diesel engines, the improvement comprising adding to a base oil, one or more amino alcohols having the formula XXXVII:

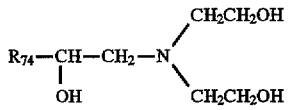

(XXXVII)

where $R_{74}$ is a linear or branched alkyl group having 10 to 14 carbon atoms, in an amount sufficient for dispersing water-containing calcium sulfate in the lubricating oil.

4. The process according to claim 3, wherein the amount of said amino alcohol is from 0.1 to 10% by weight.

5. A method of increasing the life of a lubricating oil for diesel engines which comprises adding to a lubricating oil for a diesel engine one or more additives having the formula (XXXVII):

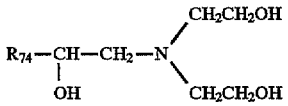

(XXXVII)

wherein $R_{74}$ is a linear or branched alkyl group having 10 to 14 carbon atoms in an amount sufficient to increase the life of the lubricating oil.

6. The method according to claim 5, wherein the amount of said additive is from 0.1 to 10% by weight.

7. A method for decreasing the formation of soot sludge around the pistons in a diesel engine which comprises adding to a lubricating oil for a diesel engine one or more additives having the formula (XXXVII):

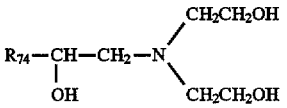

(XXXVII)

wherein $R_{74}$ is a linear or branched alkyl group having 10 to 14 carbon atoms in an amount sufficient to decrease the formation of soot sludge around the pistons in a diesel engine.

8. The method according to claim 7, wherein the amount of said additive is from 0.1 to 10% by weight.

* * * * *